US006779432B2

(12) United States Patent
Sakaki

(10) Patent No.: US 6,779,432 B2
(45) Date of Patent: Aug. 24, 2004

(54) SERVO CIRCUIT FOR USE WITH AIR PRESSURE ACTUATOR CAPABLE OF IMPROVING SPEED CONTROL PERFORMANCE

(75) Inventor: Kazutoshi Sakaki, Fujisawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 64 days.

(21) Appl. No.: 10/241,760

(22) Filed: Sep. 12, 2002

(65) Prior Publication Data

US 2004/0050241 A1 Mar. 18, 2004

(51) Int. Cl.[7] ..... F15B 9/03
(52) U.S. Cl. ..... 91/196; 91/265; 91/363 R
(58) Field of Search ..... 91/31, 196, 265, 91/358 R, 361, 363 R, 392, 397, 398

(56) References Cited

U.S. PATENT DOCUMENTS 3,757,645 A * 9/1973 Roch ..... 91/196
6,523,451 B1 * 2/2003 Liao et al. ..... 91/397

FOREIGN PATENT DOCUMENTS

JP 05321904 A * 12/1993 ..... F15B/9/09
JP 07310562 A * 11/1995 ..... F02D/1/08
JP 09196004 A * 7/1997 ..... F15B/11/04

* cited by examiner

*Primary Examiner*—Thomas E. Lazo
(74) *Attorney, Agent, or Firm*—Arent Fox PLLC

(57) ABSTRACT

An air pressure actuator has a partition wall provided on one of a slider and a guide shaft to form two cylinder chambers between the guide shaft and the slider. Intake/exhaust systems are connected with the two cylinder chambers for supplying a compressed air into the cylinder chambers or discharging the same therefrom. Two servo valves including a large capacity servo valve and a small capacity servo valve are respectively connected with the intake/exhaust systems. A position detector for detecting the position of the slider is provided on the slider. A control device receives the detection results of the position detector and a position instruction value, to select the large capacity servo valve or the small capacity servo valve in accordance with an acceleration or deceleration zone and a constant speed zone of the slider, and to control an opening degree of a selected servo valve.

4 Claims, 5 Drawing Sheets

SERVO CIRCUIT FOR USE WITH AIR PRESSURE ACTUATOR CAPABLE OF IMPROVING SPEED CONTROL PERFORMANCE

BACKGROUND OF THE INVENTION

1. Field of the Invention

The present invention relates to a servo circuit for use with an air pressure actuator.

2. Description of the Related Art

As an air pressure actuator, there has been one which was suggested by the inventors of the present invention and is shown in FIG. 1. Referring to FIG. 1, such an air pressure actuator 10 comprises a guide shaft 11 extending in one axial direction with both ends thereof fixed on a pair of support members 15, and a slider 12 movable along the guide shaft 11. In fact, the slider 12 is a cylindrical hollow body so formed that it can cover up a part of the guide shaft 11, corresponding to a predetermined length thereof. In this way, an internal space is formed between the inner surface of the slider 12 and the outer periphery surface of the guide shaft 11. Practically, such an internal space is used as a pressure chamber. In more detail, such an internal space serving as a pressure chamber has been divided (in its axial direction) into two cylinder chambers 16*a* and 16*b* by virtue of a partition wall 13 fixed on the guide shaft 11. The slider 12 is slidable over the outer periphery surface of the partition wall 13. At both ends of the slider 12 and with the cylinder chambers 16*a*, 16*b* are connected intake/exhaust systems 17*a*, 17*b* for introducing a compressed air into the cylinder chambers and for discharging the same therefrom. The intake/exhaust systems 17*a*, 17*b* are respectively equipped with servo valves 18*a*, 18*b* so as to form desired servo systems. These servo valves 18*a*, 18*b* are all connected to a compressed air supply source 100.

For example, when the servo valve 18*a* is actuated to supply a compressed air, while the servo value 18*b* is actuated to discharge an amount of used air into the surrounding atmosphere, the partition wall 13 will be caused to act as a pressure receiving plate and the slider 12 will be moved to the left direction shown in FIG. 1. In this way, by controlling the opening degree of the servo valves 18*a* and 18*b*, it is allowed to move the slider 12 to any desired position along the guide shaft 11.

The air pressure actuator 10 is provided with a position detector, thereby forming a position feed back control system.

However, as will be described later in the present specification, in an arrangement where each of the intake/exhaust system is connected with only one servo valve (as shown in FIG. 1), the speed resolving power of the air pressure actuator has been found deteriorated.

SUMMARY OF THE INVENTION

Accordingly, it Is an object of the present invention to improve the response and the speed control performance of a servo circuit which is for use with an air pressure actuator.

The servo circuit according to the present invention can be used in an air pressure actuator which has a partition wall provided on one of a slider and a guide shaft to form pressure chambers between the outer surface of the guide shaft and the internal surface of the slider, and to define these pressure chambers into two cylinder chambers arranged side by side in the axial direction.

According to an aspect of the present invention, intake/exhaust systems are connected with the two cylinder chambers for supplying a compressed air into the cylinder chambers or discharging the same therefrom. A plurality of servo valves having different maximum opening degrees are respectively connected with the intake/exhaust systems. The servo circuit further includes a position detector for detecting the position of the slider. Moreover, the servo circuit includes a control device for receiving the detection results of the position detector and a position instruction value, so as to perform a selection among a plurality of servo valves in accordance with an acceleration or deceleration zone and a constant speed zone of the slider, and to control an opening degree of a selected servo valve.

DESCRIPTION OF THE PREFERRED EMBODIMENTS

Figure 1:
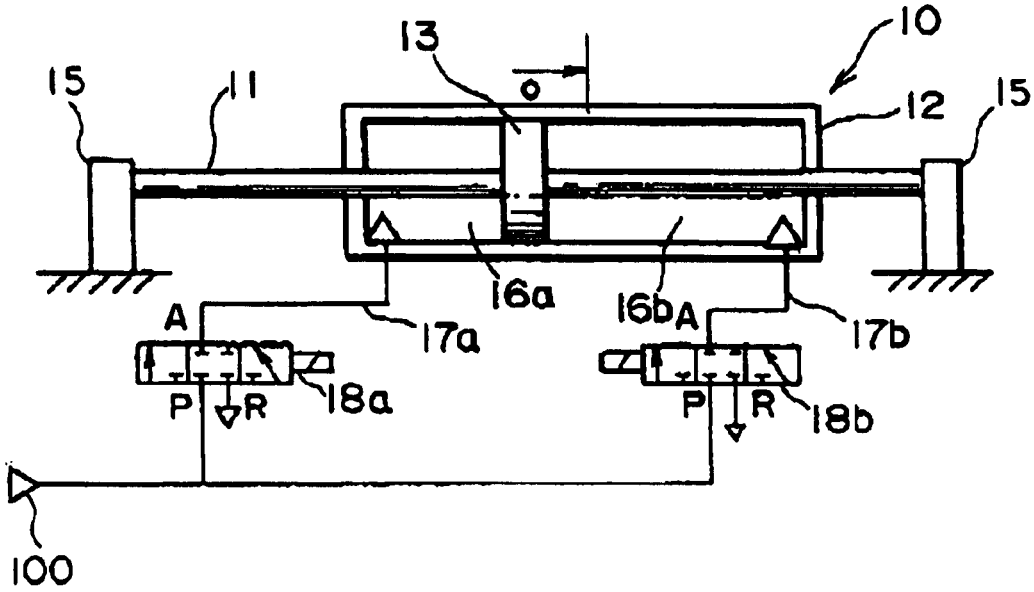
FIG. 1 RELATED ART
FIG. 1 is a cross sectional view showing as an example a basic constitution of an air pressure actuator suggested by the inventors of the present invention.

In the following, with reference to FIG. 2, description will be given to explain a servo circuit for use with an air pressure actuator and formed according to one embodiment of the present invention. In fact, the present embodiment is based on the condition in which the present invention is applied to the air pressure actuator of FIG. 1, so that elements or members which are the same as those shown in FIG. 1 will be represented by the same reference numerals.

As shown in the drawing, the servo circuit for use with an air pressure actuator and formed according to the present embodiment, is characterized in that each of its intake/exhaust systems 17*a*, 17*b* has two servo valves so that the systems include servo valves 18*a*, 28*a*, 18*b*, 28*b*. Every two servo valves have different maximum opening degrees corresponding to an acceleration or deceleration zone and a maximum speed of the slider 12. Here, the servo valves 18*a* and 18*b* are all small capacity valves for use in speed control, while the servo valves 28*a* and 28*b* are all large capacity servo valves for acceleration or deceleration of the slider 12.

Further, the slider 12 is provided with a position detector 21. A control device 20 comprises a controlling and computing unit 20-1 which receives a position detection signal from the position detector 21 and a position instruction value (which have already been set), so as to control the operation timings of the four servo valves 18*a*, 28*a*, 18*b*, 28*b* and to produce opening degree instruction values as control signals, all in accordance with predetermined operation patterns. The control signals are fed to the servo valves 18*a*, 28*a*, 18*b*, 28*b* through valve amplifiers 22*a*, 22*b*, 22*c*, 22*d*. Meanwhile, the position instruction value is issued from a setting device or a main control device (not shown).

Figure 3A:
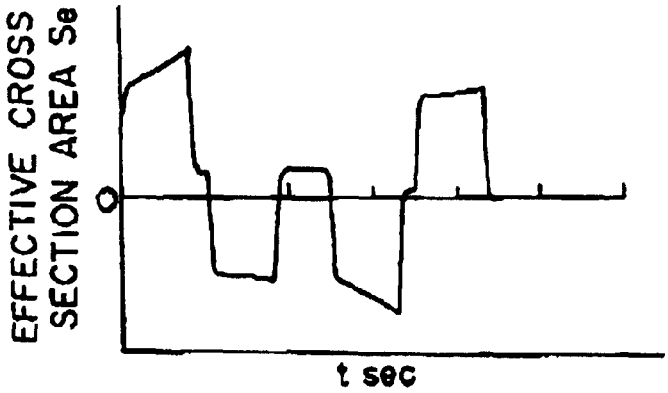
FIGS. 3A to 3D are characteristic graphs showing the results of simulation test performed on the servo valves used in the servo circuit shown in FIG. 2.
Figure 3B:
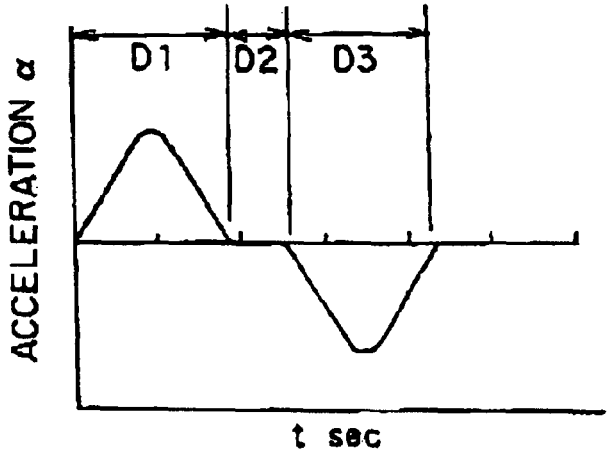
Figure 3C:
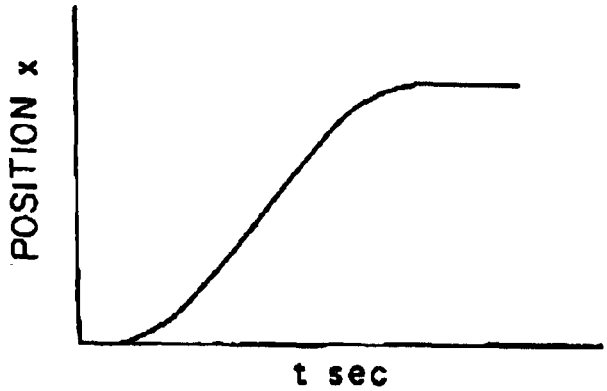
Figure 3D:
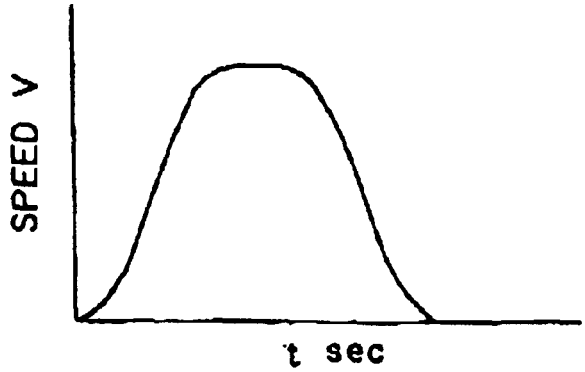

FIGS. 3A to 3D are characteristic graphs showing the results of response simulation test performed on the servo circuit, under a condition in which an operation pattern such as jerk (acceleration differential) has been set. In more detail, FIG. 3A shows a relationship between an effective cross section area Se of a servo valve and a time, FIG. 3B shows a relationship between an acceleration $\alpha$ of the slider 12 and a time. FIG. 3C shows a relationship between the position x of the slider 12 and a time. FIG. 3D shows a relationship between the speed V of the slider 12 and a time.

Actually, the following facts can be understood from the simulation test results shown in FIG. 3A to FIG. 3D.

(1) A maximum opening degree of each servo valve will become the largest in an acceleration or deceleration zone.

(2) An opening degree of each servo valve in a constant speed zone of the slider 12 is extremely small as compared with the acceleration or deceleration zone.

The reasons for the above facts are as follows. Namely, in the acceleration or deceleration zone, the pressures within the cylinder chambers are increased or decreased until an actual speed is increased or decreased to a set value. For this reason, it is necessary to supply or discharge a large amount of compressed air during a short time period, thereby requiring each servo valve to be opened to an appropriate opening degree corresponding to a real necessity for supplying or discharging the compressed air.

When it is required to effect a quick response of the servo systems, the above phenomena and necessity will become more remarkable.

Further, an opening degree of each servo valve at the time of the maximum speed within the constant speed zone, as discussed above, is extremely small and much smaller than an opening degree during the acceleration or deceleration. Accordingly, in an arrangement where each of an intake/exhaust system includes only one servo valve (as shown in FIG. 1), the speed resolving power will become deteriorated.

For instance, in an arrangement shown in FIG. 1, it is assumed that a necessary valve opening degree at the time of acceleration is 100%, while an opening degree at the time of the maximum speed is 10%. On the other hand, if the precision of the flow rate of the valve is 0.1%, a speed resolving power will become 1%.

Referring to FIG. 3B, zone D1 is an acceleration zone, zone D2 is a constant speed zone, and zone D3 is a deceleration zone. At this time, when in zone D1 and zone D3, the control device 20 operates to select a large capacity servo valve 28*a* or 28*b*, and outputs a valve opening degree instruction value corresponding to a control deviation. During this period, the small capacity servo valve 18*a* or 18*b* for use in speed control is controlled in a manner such that its opening degree becomes zero.

In the constant speed zone D2, the control device 20 operates to control the movement of the slider 12 by using only the small capacity speed control servo valve 18*a* or 18*b*. During this period, the large capacity servo valve 28*a* or 28*b* for acceleration is controlled in a manner such that its opening degree becomes zero. However, this is only one example and it is possible to perform other control pattern.

Next, with reference to FIG. 4, description will be given to explain a concrete example of the air pressure actuator 10 to which the servo circuit of the present invention can be suitably applied. In this concrete example, the guide shaft 11 is a shaft member having a quadrangle cross section. The slider 12 also has a quadrangle cross section having an internal space of similar quadrangle cross section which allows the insertion of the guide shaft 11 therethrough. In particular, there is only a very small clearance between the internal wall of the slider 12 and the outer periphery surface of the guide shaft 11. Here, the guide shaft 11 has been made to have a small diameter portion in a manner such that a pressure chamber is formed in an area close to the central portion of the guide shaft 11. Further, in this concrete example, in order to divide the pressure chamber into two cylinder chambers 16*a* and 16*b*, a partition wall 13 is fixed on the internal wall of the slider 12. In fact, the partition wall 13 is slidable along the guide shaft 11. Of course, the partition wall 13 can also be fixed on the guide shaft 11, as in an example shown in FIG. 2.

Next, description will be given to explain the structure on the side of the cylinder chamber 16*a*, which is one of the two divided cylinder chambers 16*a*, 16*b*. However, the same explanation can also apply to the structure on the side of the cylinder chamber 16*b*.

In order to introduce a compressed air into or discharge the same out of the cylinder chamber 16*a*, an air passage 11-1 is formed through the core portion of the guide shaft 11, extending from one end of the guide shaft towards the central portion thereof. Such an air passage 11-1 is branched into several directions in the vicinity of the cylinder chamber 16*a* so as to be communicated with the cylinder chamber 16*a*. In this way, it is possible to form a uniform pressure distribution within the cylinder chamber 16. The other end of the air passage 11-1 close to the one end of the guide shaft 11 is connected with an air pipeline (not shown) via a connection portion 11-1*a*. Further, the two servo valves shown in FIG. 2 are connected with the air pipeline. In addition, the maximum stroke of the slider 12 depends on the axial sizes of the cylinder chambers 16*a* and 16*b*.

Figure 5:
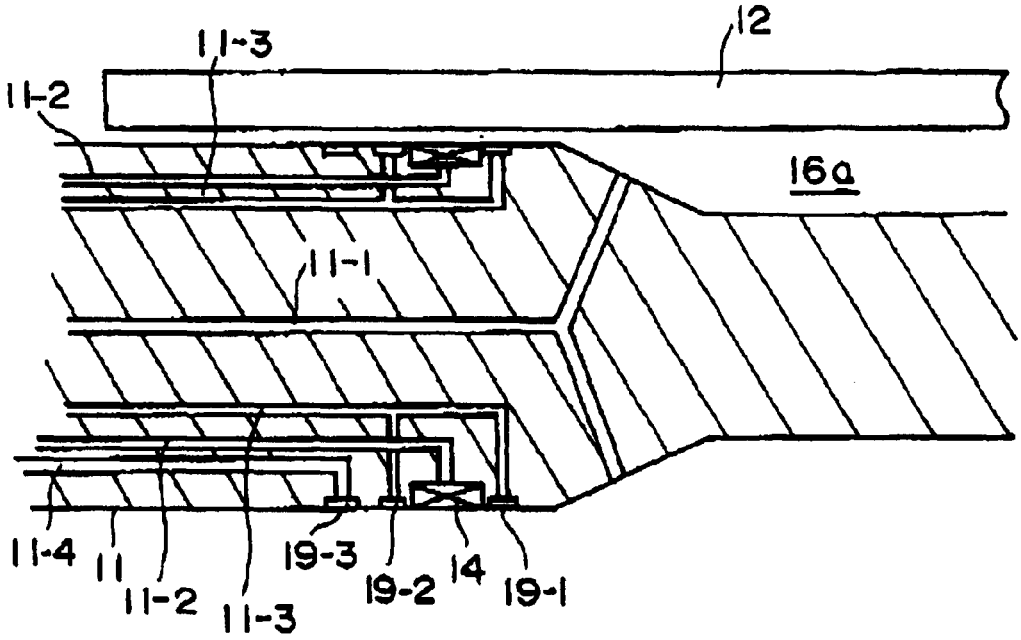
FIG. 5 is an enlarged sectional view showing a static pressure air bearing unit, an exhaust unit and a vacuum discharge unit, as well as several air passages provided in the guide shaft for connecting the above units with air pipelines, shown in FIG. 4.

Referring to FIG. 5, in the vicinity of the cylinder chamber 16*a* and around the guide shaft 11, a static pressure air bearing 14 is provided. Meanwhile, exhaust portions 19-1 and 19-2 are provided on both sides of the static pressure air bearing 14. Here, since the guide shaft 11 has the quadrangle cross section, the static pressure air bearing 14 is provided on the four outer surfaces of the guide shaft. Because the static pressure air bearing is already well known in the art, a detailed explanation thereof is omitted from the present specification. Further, exhaust portions 19-1 and 19-2 are provided to discharge leaked air from the cylinder chamber 16*a* as well as the air from the static pressure air bearing 14. Here, in order to effect a smooth air discharge, a plurality of grooves are formed around the guide shaft 11, thereby ensuring an effective air discharge through these grooves. In addition, the guide shaft 11 is also provided with a vacuum discharge portion 19-3 located outwardly of the static pressure air bearing 14 in the axial direction of the guide shaft 11.

Figure 4:
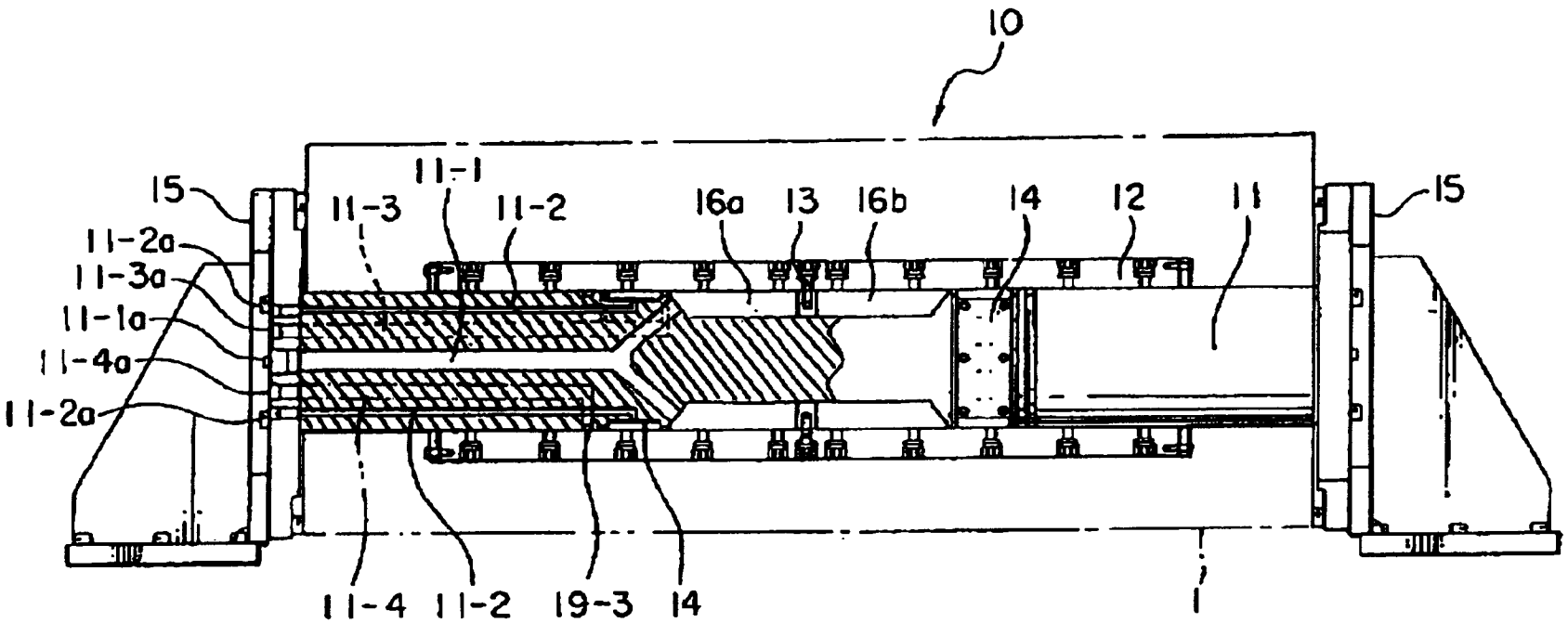
FIG. 4 is a sectional view showing in detail an example of an air pressure actuator to which the present invention can be suitably applied.

The provision of the vacuum discharge unit 19-3 is for properly dealing with a situation in which the air pressure actuator is operated within a vacuum chamber 1 shown by a chain line in FIG. 4 Similarly, in order for the vacuum discharge portion 19-3 to perform a smooth air discharge, a plurality of grooves are formed around the guide shaft 11, thereby ensuring an effective air discharge by means of vacuum through these grooves.

Furthermore, in order to supply a compressed air to the static pressure air bearing 14, a plurality of air passages 11-2 are formed within the guide shaft 11, extending from one end of the guide shaft 11 to the static pressure air bearing 14. In addition, the guide shaft 11 is also provided with a plurality of air discharge paths 11-3 extending from one end of the guide shaft 11 to the discharge portions 19-1 and 19-2. Further, the guide shaft 11 is provided with another air passage 11-4 extending from one end of the guide shaft 11 to the vacuum discharge portion 19-3. Moreover, it is preferable that the air passage 11-4 is communicated with the grooves of the vacuum discharge portion 19-3, and that holes are formed on each of the four outer surfaces of the guide shaft 11 so that the air passage 11-4 is also communicated with these holes. Although in FIG. 5, several types of air passages provided in the guide shaft 11 are all represented by solid lines for convenience, these air passages are of course disposed in circumferentially different positions within the guide shaft 11.

Figure 2:
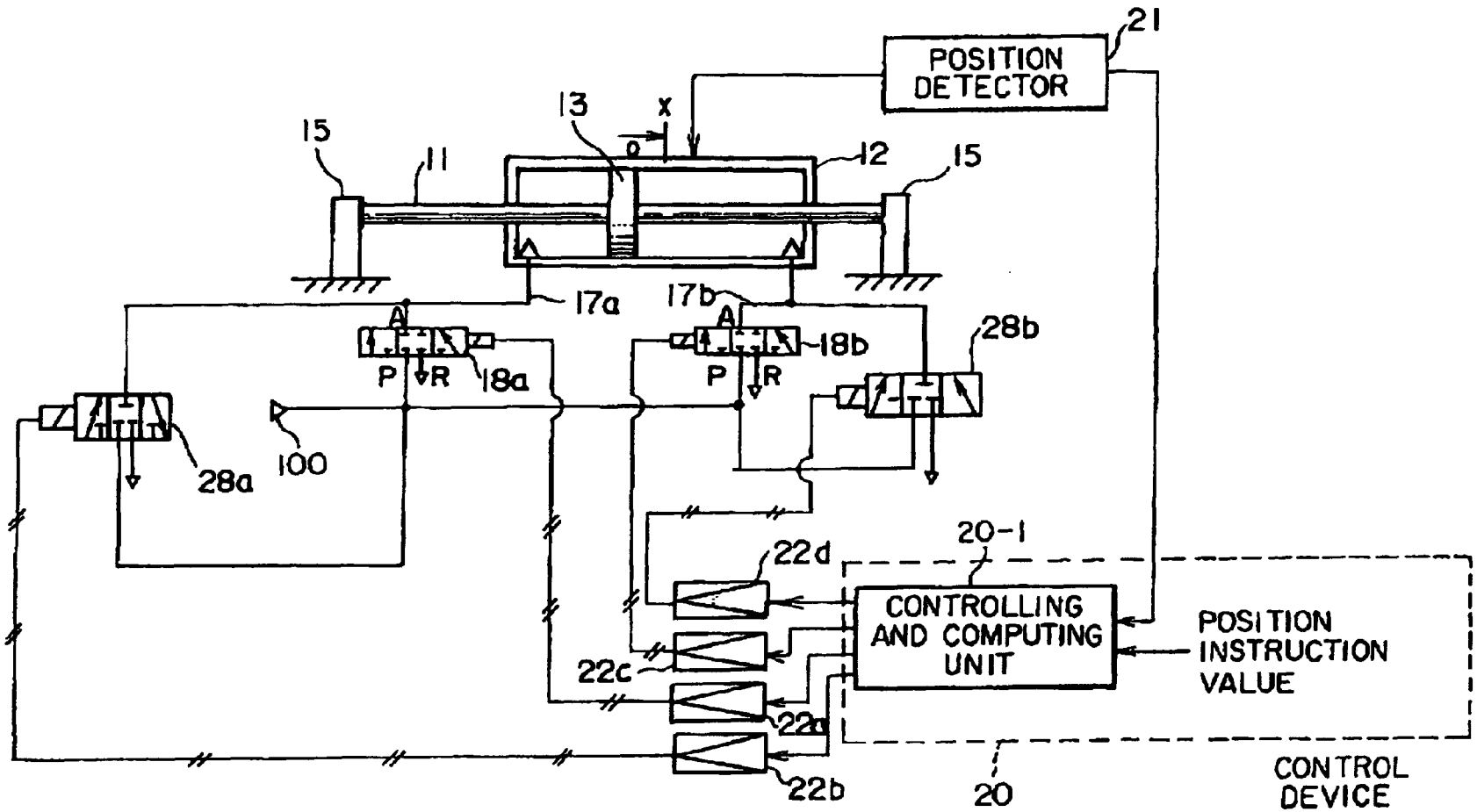
FIG. 2 is an explanatory view showing the constitution of a servo circuit which is for use with the aforesaid air pressure actuator, and is formed according to the present invention.

The plurality of air passages 11-2 are connected with the air pipelines (not shown) via connection portions 11-2*a* at the end of the guide shaft 11, and further connected with a compressed air supply source 100 (see FIG. 2). Similarly, the plurality of air passages 11-3 are also connected with the air pipelines (not shown) via connection portions 11-3*a* at the end of the guide shaft 11 and further connected with an air discharge pump (not shown). Moreover, the plurality of air passages 11-4 are also connected with the air pipelines (not shown) via connection portions 11-4*a* at the end of the guide shaft 11, and further connected with a vacuum suction pump (not shown).

However, when the air pressure actuator is provided within the vacuum chamber as shown in FIG. 4, both ends of the guide shaft 11 are disposed through side walls of the vacuum chamber 1, in a manner such that they are supported by a pair of support members 15 on the side walls of the vacuum chamber 1. In such an arrangement, an operation for connecting the air pipelines with the respective grooves at both ends of the guide shaft 11 can be performed on the outside of the vacuum chamber 1.

On the other hand, in the case where the air pressure actuator is used under a high vacuum condition such as a vacuum chamber in an electron beam exposing apparatus, it is necessary that the materials forming the aforementioned various elements be a non-magnetic material such as an alumina ceramic or a beryllium copper, thereby avoiding any undesired influence on the magnetic field which controls an electron beam orbit.

Although it has been described in the above embodiment that two servo valves are used which have different maximum opening degrees, it is in fact also possible to use three or more than three servo valves when there are a plurality of constant speed zones having different speeds.

With the use of the present invention, it becomes possible to select an appropriate valve opening degree in accordance with the maximum acceleration and the maximum speed specification of the slider. As a result, although in the example shown in FIG. 1, the speed control performance will be determined in proportion to the valve opening degree at the time of the maximum speed, the present embodiment shows that since the valve opening degree can be set independently, it is allowed to improve the response and speed control performance of the servo circuit.

What is claimed is:

1. A servo circuit for use with an air pressure actuator wherein the air pressure actuator includes a guide shaft extending in one axial direction and a slider movable along the guide shaft, and wherein a partition wall is provided on one of the slider and the guide shaft to form pressure chambers between the outer surface of the guide shaft and the internal surface of the slider, and to define these pressure chambers into two cylinder chambers arranged side by side in the axial direction, said servo circuit comprising:

intake/exhaust systems connected with the two cylinder chambers for supplying a compressed air into the cylinder chambers or discharging the compressed air from the cylinder chambers;

a plurality of servo valves provided in each of the intake/exhaust systems and having different maximum opening degrees;

a position detector for detecting the position of the slider; and a control device receiving the detection results of the position detector and a position instruction value for performing a selection among a plurality of servo valves in accordance with an acceleration or deceleration zone and a constant speed zone of the slider, and for controlling an opening degree of a selected servo valve.

2. A servo circuit according to claim 1, wherein the plurality of servo valves having different maximum opening degrees are two servo valves including a large capacity servo valve and a small capacity servo valve.

3. A servo circuit according to claim 2, wherein the control device operates to select the large capacity servo valve when in the acceleration or deceleration zone and produces a valve opening degree instruction value corresponding to a control deviation, and performs a control to make an opening degree of the small capacity servo valve to be zero, also to control the movement of the slider when in the constant speed zone, by means of only the small capacity servo valve, so as to make the opening degree of the large capacity servo valve to be zero.

4. A servo circuit according to claim 1, wherein in order to supply a compressed air into the two cylinder chambers or to discharge the compressed air from the two cylinder chambers, the guide shaft is provided with air passages extending from both ends of the guide shaft to the respective cylinder chambers, and connection portions for use in pipeline connection are provided at both ends of the guide shaft.

* * * * *